United States Patent [19]

Hoop

[11] 4,118,082

[45] Oct. 3, 1978

[54] ADVERTISEMENT PILLAR

[75] Inventor: William J. Hoop, Eschen, Liechtenstein

[73] Assignee: Gamperdona Handels- und Finanz Aktiengesellschaft, Liechtenstein

[21] Appl. No.: 722,755

[22] Filed: Sep. 13, 1976

[30] Foreign Application Priority Data

Mar. 24, 1976 [CH] Switzerland ..... 3446/76
May 10, 1976 [CH] Switzerland ..... 5827/76

[51] Int. Cl.[2] ..... A47B 49/00

[52] U.S. Cl. ..... 312/59; 312/97.1; 312/202; 312/223

[58] Field of Search ..... 312/59, 102, 202, 223, 312/201, 97.1, 197

[56] References Cited

U.S. PATENT DOCUMENTS

| | | | |
|---|---|---|---|
| 888,142 | 5/1908 | Bonesteel | 312/202 |
| 1,208,921 | 12/1916 | Davis | 312/59 |
| 1,416,566 | 5/1922 | McCleary | 312/223 |
| 2,016,127 | 10/1935 | Weiler | 312/97.1 |
| 2,300,345 | 10/1942 | Clerc | 312/223 |
| 2,599,722 | 6/1952 | Rourke, Jr. et al. | 312/97.1 |
| 2,808,918 | 10/1957 | Shepard, Jr. et al. | 312/223 |
| 2,811,403 | 10/1957 | Barker et al. | 312/97.1 |
| 2,825,616 | 3/1958 | Cole, Jr. | 312/223 |
| 2,887,204 | 5/1959 | Giuliano | 312/223 |
| 3,297,378 | 1/1967 | Krug et al. | 312/223 |

*Primary Examiner*—Kenneth Downey
*Assistant Examiner*—Victor N. Sakran
*Attorney, Agent, or Firm*—Cushman, Darby & Cushman

[57] ABSTRACT

An advertisement pillar for use on public streets, squares or in buildings for displaying advertising cards which can be dispensed in blank form and thereafter reinserted into the device for subsequent display. The pillar is comprised of an outer transparent housing in which a revolving display unit is positioned. The advertising cards are removably attached to mounting panels which can, if desired, be transparent and provided with a rear light source.

7 Claims, 1 Drawing Figure

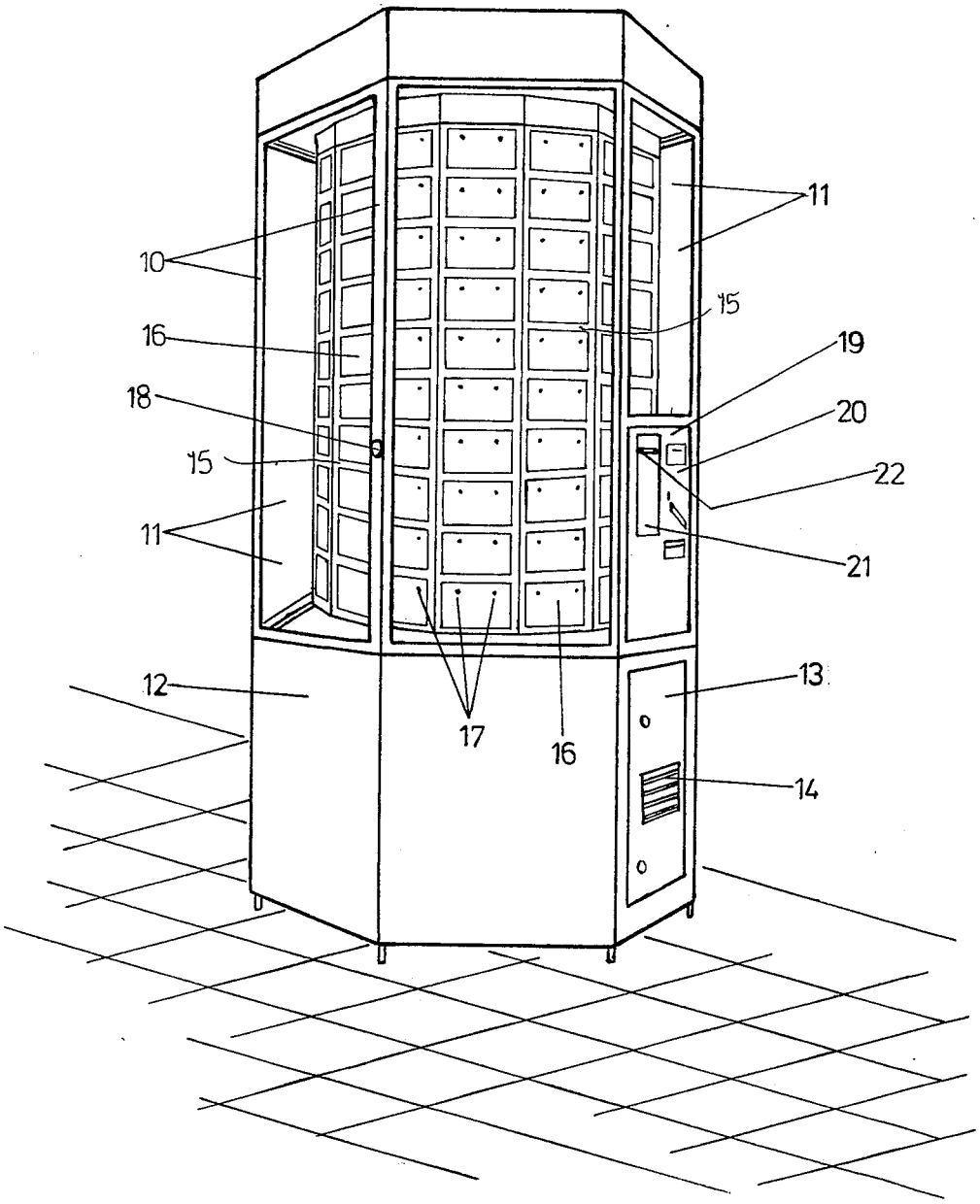
11
10
15
16
19
18
20
15
22
11
21
12
13
17
16
14

ADVERTISEMENT PILLAR

The present invention relates to a pillar for advertisements, preferably for public streets and squares, but also for department stores, restaurants and similar localities open to the public. Pillars for advertisements or placards which serve for bill posting and are the property of, or are rented by, appropriate advertising agencies are known. Accordingly these advertisement pillars can only be used through the medium of the advertising companies in question and are suitable only for placards of large size.

In addition there are in existence advertising boards for affixing advertisement cards of smaller size intended for public display. Such boards are used for example by bureaux for letting flats and by employment agencies advertising job vacancies. Such advertisement boards also can only be used via their owners, i.e., through the intermediary of the bureaux in question.

There is, however, frequently a need to advertise to the public at large in a simple and uncomplicated manner articles for sale or wanted to purchase, lost property, vacant premises, search announcements and the like, without the intermediary of firms or agencies. The present invention represents a solution of this problem and relates to an advertisement pillar, preferably for public streets and squares, but also for department stores, restaurants and other localities frequented by the public, characterized by a housing of columnar structure having a plurality of transparent windows and disposed therewithin rotatable panels for affixing large and/or small placards or advertisement cards, and by an arrangement controllable from without the housing for driving the panels.

In the following the invention is described in greater detail with reference to an exemplary embodiment illustrated in the accompanying drawing which shows a schematic perspective view of the advertisement pillar according to the invention.

In the illustrated exemplary embodiment the advertisement pillar is formed by a columnar housing 10 which in our case has the plan view of an equilateral hexagon for example. This housing 10 is provided with windows 11 covered with transparent material and underneath the windows 11 there is a base or pedestal portion 12 provided with ventilation slots 14 in a lockable door 13. Interiorly of the hexagonal housing 10 there are rotatably arranged display boards or advertisement panels 15 which in the present case are assembled to form a rotary body the plan view of which forms an equilateral polygon and which is mounted for rotation in the pedestal 12. The rotatable advertisement panels 15 are equipped for affixing large or smaller placards or advertisement cards or announcements, the advertisement cards 16 each having at their upper edge two suspension holes and being adapted to be hung on the advertisement panels from corresponding hooks 17.

In the pedestal portion 12 of the housing 10 there is disposed a device for driving the advertisement panels 15 which device can be controlled from the outside. In the present embodiment an electric drive arrangement having a motor and a suitable step-down transmission is provided, whereby a constant slow rotation of the advertisement panels 15 is effected when the advertisement pillar is operational. At various positions on the extreior of the housing 10 there are mounted suitable switches or push buttons 18 which, when actuated, disconnect the motor for an interval which can be set in the pedestal 12, so that the rotation of the panels 15 is interrupted for the duration of the interval. If desired, the electric drive of the rotatable panels 15 provided in the pedestal 12 may alternatively be arranged such that the motor is engaged for a settable period only upon actuation of a switch 18, so that the advertisement panels 15 are turned by a specific angle. It is also possible to dispense with the switches 18 and to provide an automatic start-stop apparatus for the drive mechanism.

In the present exemplary embodiment there is provided in the housing 10 an outwardly openable door 19 carrying an automatic mechanism 20 arranged to deliver, upon insertion of a coin, a blank advertisement card suitable for writing thereon. Such automatic card dispensers are universally known so that no detailled description is necessary. The door 19 furthermore carries a container 21 for the advertisements dropped through the posting slot 22.

Additionally a time switch of known construction can be provided in the pedestal 12 which time switch for example switches the drive mechanism and the illumination of the panels disposed in the housing 10 on or off at selected times. This time switch can, for example, regularly switch the advertisement pillar off at midnight and automatically switch it on again at 6 o'clock in the morning.

The advertisement pillar according to the above described exemplary embodiment enables any passer-by to study the various advertisement cards 16 and to control the revolution of the advertisement panels 15 by means of the switches 18. Additionally, any passer-by has an opportunity of acquiring a blank advertisement card 16, ready to be inscribed, by inserting a coin into the automatic dispenser 20, to write the desired wording thereon and to post the card in the slot 22. The amount of money inserted in the dispenser 20 covers the fee for displaying the posted advertisement card on one of the panels 15 for a specific period, e.g. 3 days. After opening the door 19 the advertisement cards 16 newly accumulated in the container 21 are daily inspected by an operator, any unsuitable cards or cards contravening the regulations are removed and the individual advertisement cards are then secured at an unoccupied site of the advertisement panels 15. Suitably the operator will note the expiry date of the period of advertising before affixing the card 16 to the panel 15 so that the operator may remove the card in question from the panel at the end of the period. The delivery of blank advertisement cards 16 by the coin-operated machine 20 also provides the possibility of not immediately completing and inserting such cards through the slot 22, but rather to insert them at a later time when more time is needed for writing thereon.

The above described advertisement pillar represents only one practicable embodiment. For some purposes the provision of an automatic dispenser 20 for supplying advertisement cards will be omitted when the respective panels are let to regular customers for extended periods of time. When such advertisment pillars are used in department stores, for example for announcing special offers, a card dispenser 20 will not be required either.

It is also possible to employ an automatic card dispenser 20 which issues different advertisement cards depending on the amount of money inserted, one kind being intended for an advertising period of 3 days for example and another kind for an advertising period of 6 days.

With an advertisement pillar of the present construction it is also possible to design the advertising panels 15 in such manner that both advertisement cards of a predetermined format and placards of larger size may be affixed. Letting of advertising space on the panels can thus be combined with the above described delivery by the automatic dispenser of advertisement cards of a specific format. Suspension of the advertisement cards 16 from hooks 17 may be replaced by securing the cards by their corners, as in an album. The external design of the housing and of the internal panels of the present advertisement pillar may also be adapted to the respective requirements. If desired, the advertisement panels may form the mantle of a circular revolving body. Such an advertisement pillar may alternatively be partially embedded in the wall of a building and have, for example, only one or two windows 11, which is feasible because the rotary body having the advertisement panels and contained within the housing moves past the window openings.

In a further exemplary embodiment of the present advertisement pillar panels 15 are provided at least some areas of which are transparent and have a source of light arranged at the rear of at least these areas. It is known that, apart from conventional picture postcards, transparencies are sold in holiday resorts and souvenir shops, such transparencies comprising for example a transparent photograph of 24 × 36 mm format contained in a paper or plastics frame of 50 × 50 mm size. The present advertisement pillar may then be used to advertise the transparencies being stocked, for example when the panels 15 consist of an opaque, white and matt plastics material and a number of vertical tubular sources of light, e.g., fluorescent tubes, are mounted interiorly of the rotary body formed by the advertisement panels 15. The transparencies can be accomodated by means of slide rails forming a plurality of vertically superposed compartments, it being possible to slide the frames of the respective transparencies sideways into these compartments. The individual compartments are advantageously provided with consecutive numerals which are clearly visible through the windows 11, so that every transparency is identified by one of these numerals. In this manner selecting any of the transparencies in stock may be facilitated, especially when a suitable advertisement pillar is situated outside an associated shop and the available transparencies are sorted in the same numerical order inside the shop.

Alternatively it is possible to incorporate into the housing 10 of the advertisement pillar an automatic vending machine which is so arranged that the desired transparencies are selected by means of a numerical selector and delivered by the automatic vending machine after insertion of coins.

The advertisement pillar of the above described construction having panels 15 which are transparent at least in some of their areas may, of course, also be used for other transparent placards or pictures. Even when, as described above, all the panels 15 consist of opaque material and a source of light is provided inside the rotary body, it is still possible to affix posters or advertisement cards which are not transparent, i.e., to utilize the advertisement pillar simultaneously for transparent articles and for posters or card-like articles which are not transparent.

I claim:

1. An advertising and information display column for publicly displaying on streets and in public squares a plurality of advertisements said display column comprising an outer housing having upper and lower portions, said upper portion including frame means for supporting a plurality of sidewalls a plurality of which are comprised of a transparent material, one of said plurality of sidewalls comprising a lockable door adapted to be opened outwardly, a card vending means attached to said door for vending a blank advertising card in response to a predetermined signal, said upper portion further including a card collection means for collecting the previously vended cards following the placement of advertising thereon so that the cards will be available in said display column for subsequent display therein, an inner card display member rotatably mounted to said lower portion and within said upper portion so that said display member is spaced inwardly of the sidewalls forming the upper portion of said outer housing, said inner card display member having a plurality of sides each side having a plurality of card holding means for holding the vended cards which had been collected in said card collection means so that the cards will be visible through the transparent sidewalls of the upper portion, electric drive means mounted within said lower portion and being drivingly connected to said inner card display member for rotating said member said lower portion having a lockable door to provide access to said electric drive means and drive control means positioned on the exterior of said outer housing for controlling the operation of said drive means and the rotation of said inner card display member.

2. An advertisement pillar as in claim 1 wherein said drive means is designed to intermittently rotate said inner display member, said drive control means including at least one switch fitted to said outer housing and actuable from outside for the purpose of automatically controlling the rotation of said inner display member for a predetermined period of time.

3. Advertisement pillar according to claim 1 wherein said electric drive means being designed for a constant slow revolving of said inner display member, said drive control means including at least one switch fitted to the outer housing and actuable from outside, for the purpose of interrupting the rotation for a settable period of time.

4. Advertisement pillar according to claim 1 characterized by a polygonal rotary body the length of a side of which is so adapted to the width of advertising cards that in every case a plurality of such advertisement cards can be affixed one above the other on each advertisement panel.

5. Advertisement pillar according to claim 1 characterized by advertisement panels designed for affixing of at least partially transparent placards of any desired format.

6. Advertisement pillar according to claim 1 characterized by an arrangement of numerals on the advertisement panels, each numeral being associated with one of the advertisements for identification thereof.

7. Advertisement pillar according to claim 1 characterized by advertisement panels comprised of opaque, white and matte plastics material.

* * * * *